United States Patent [19]

Haworth et al.

[11] Patent Number: 5,018,248

[45] Date of Patent: May 28, 1991

[54] DRAFTING APPARATUS WITH AUTOLEVELLING

[75] Inventors: Walter Haworth, Rossendale; Alfred Wood, Oldham, both of England

[73] Assignee: Hollingsworth (U.K.) Limited, Accrington, United Kingdom

[21] Appl. No.: 382,812

[22] Filed: Jul. 19, 1989

[30] Foreign Application Priority Data

Aug. 9, 1988 [GB] United Kingdom ..... 8818869
Feb. 7, 1989 [GB] United Kingdom ..... 8902708

[51] Int. Cl.[5] ..... D01H 5/32; D01H 5/42

[52] U.S. Cl. ..... 19/240; 19/239; 19/236

[58] Field of Search ..... 19/236, 237, 239, 240, 19/300

[56] References Cited

U.S. PATENT DOCUMENTS

| | | | |
|---|---|---|---|
| 2,681,475 | 6/1954 | Raper | 19/240 |
| 2,810,936 | 10/1957 | Altenburger | 19/240 |
| 3,141,202 | 7/1964 | Linnert et al. | 19/240 |
| 3,314,114 | 4/1967 | Wyatt | 19/240 |
| 3,440,690 | 4/1969 | Greenwood et al. | 19/240 |
| 3,457,597 | 7/1969 | Tooka et al. | 19/258 |
| 4,137,487 | 1/1979 | Niestroj et al. | 19/240 |
| 4,266,324 | 5/1981 | Hasegawa et al. | 19/239 |
| 4,275,483 | 6/1981 | Roberson | 19/240 |
| 4,473,924 | 10/1984 | Hartmannsgruber et al. | 19/239 |
| 4,530,134 | 7/1985 | Hösel | 19/105 |
| 4,703,431 | 10/1987 | Sako et al. | 19/240 |
| 4,812,993 | 3/1989 | Konig et al. | 19/239 |
| 4,819,301 | 4/1989 | Konig et al. | 19/240 |
| 4,864,694 | 9/1989 | Konig et al. | 19/240 |

FOREIGN PATENT DOCUMENTS

| | | | |
|---|---|---|---|
| 465454 | 12/1968 | Switzerland | 19/240 |
| 1135752 | 12/1968 | United Kingdom | 19/240 |

*Primary Examiner*—Werner H. Schroeder
*Assistant Examiner*—Michael A. Neas
*Attorney, Agent, or Firm*—Cort Flint

[57] ABSTRACT

A drafting system and autoleveller are arranged such that the "tongue" roller and the "grooved" roller of the sliver sensor ahead of the first drafting rollers serve to measure the thickness of the sliver therebetween, and their output signal is used, subject to a time delay, to vary the draft ratio in the subsequent drafting means. The autoleveller throughput speed is adjustable and the time delay in the draft ratio variation is automatically adjusted in response to the speed selected.

11 Claims, 1 Drawing Sheet

DRAFTING APPARATUS WITH AUTOLEVELLING

FIELD OF THE INVENTION

The present invention relates to a drafting system with an autolevelling facility. One example of the drafting system to which the present invention is applicable is the combination of an autoleveller and output draft box for carding apparatus.

PRIOR ART

When autolevelling a sliver being drafted, various different ways are known of measuring the sliver weight, including sensing mechanical thickness, measuring resistance to penetration by an air current, and optical observation by a photoelectric cell.

One example of the mechanical thickness sensing is the use of "tongued and grooved" rollers in which a cylindrical peripheral surface of a "tongue" roller, or of an outwardly projecting tongue on the periphery of a roller, is biased towards a "grooved" roller to enter and mesh with a peripheral groove in the "grooved" roller so that the space defined between, on the one hand, the flanks of the groove in the "grooved" roller and, on the other hand, the facing surfaces of the "tongued" roller periphery and the groove floor, defines a channel through which the sliver passes and in which any changes in volume of the sliver will result in movement of the rollers to bring their axes further apart from one another or closer to one another.

Traditionally a drafting autoleveller uses the "tongued and grooved" rollers as the first drafting nip in a drafting train involving at least one subsequent drafting nip which the peripheral speed of the drafting rollers or aprons is higher than the peripheral speed of the floor of the groove at the tongued and grooved roller sliver sensing point.

OBJECTS OF THE INVENTION

It is an object of the present invention to provide an autolevelling drafting apparatus in which the throughput rate of the apparatus is adjustable without any appreciable change in the degree of accuracy in the autolevelling operation.

It is another object of the invention to enable the throughput speed of autolevelling drafting apparatus to be varied in a simple manner than hitherto and without having to store sliver between the drafting system and the coiler.

SUMMARY OF THE INVENTION

Accordingly, the present invention provides drafting apparatus comprising a series of drafting nips and an autoleveller for controlling the drafting ratio, said autoleveller including a sliver sensing system ahead of the drafting nips, means for controlling the draft ratio of said drafting nips in response to a signal from said sliver sensing system, time delay means for ensuring that the correcting drafting adjustment is effected when the sensed part of the sliver is in the region of the controllable ratio drafting nips, means for adjusting the throughput speed of the drafting apparatus, and means responsive to the throughput speed adjustment means for varying the time delay effected by said time delay means.

Preferably the time delay varying means comprise a programmable logic controller effective to vary the time delay in inverse proportion to the throughput speed selected. More preferably the said programmable logic controller computes the time delay as a linear function of the reciprocal of the throughput speed, corrected by subtraction of a constant.

The coiler may be arranged to receive the sliver delivered from said drafting means without any intervening storage, and means mechanically linking the drive to said coiler to the drive of the final drafting nip may ensure variation of the coiler speed and the final drafting speed in a constant relationship.

BRIEF DESCRIPTION OF THE DRAWINGS

In order that the present invention may more readily be understood the following description is given, merely by way of example, with reference to the accompanying drawing in which.

DESCRIPTION OF THE PREFERRED EMBODIMENT

Figure 1:
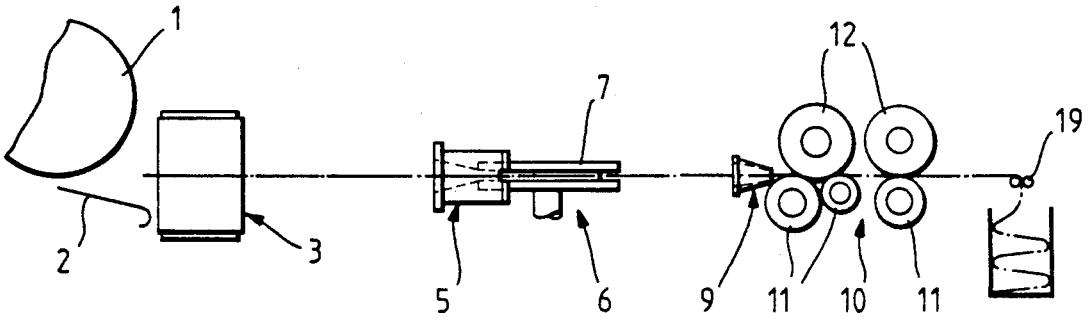
FIG. 1 is a side elevational view of the sliver delivery region of carding apparatus, including a draft box and autoleveller sensor.
Figure 2:
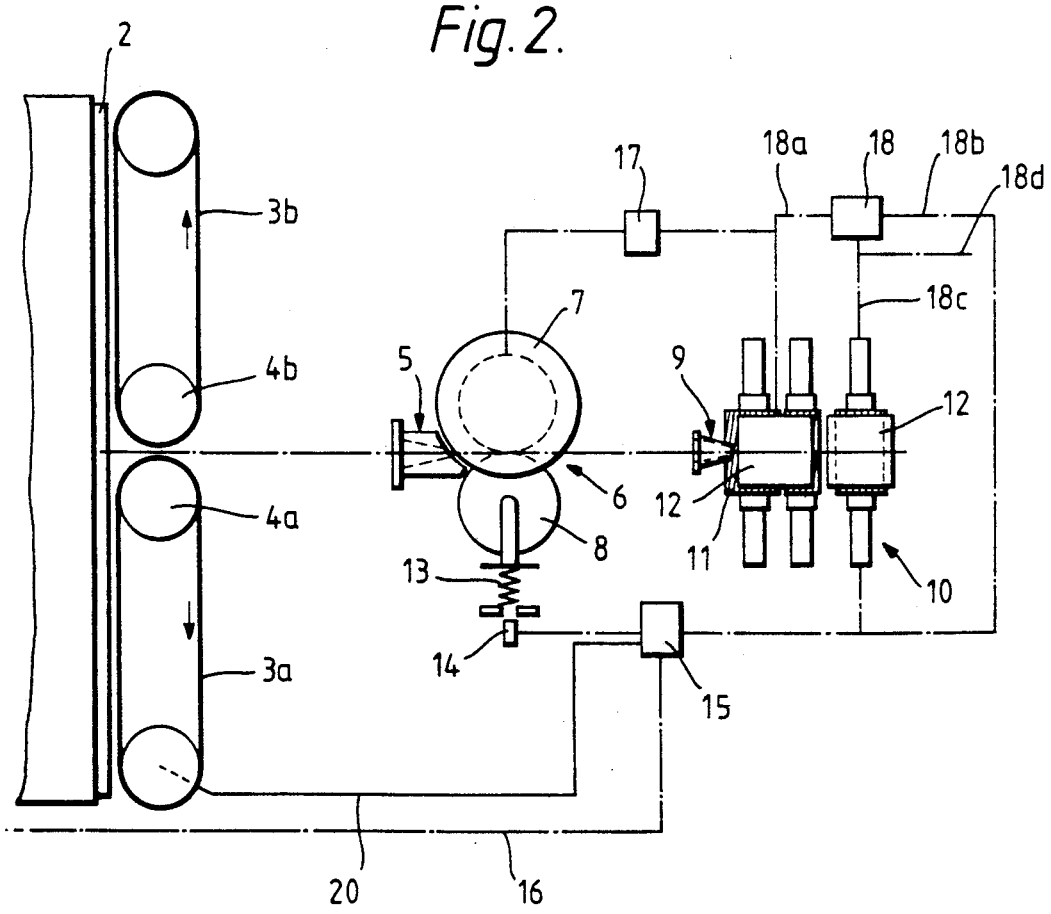
FIG. 2 is a top plan view of the apparatus of FIG. 1.

FIG. 1 shows a doffing roller 1 of carding apparatus, preferably a fluted doffing roller of the type disclosed in our GB-A-2192409, and a guide plate 2 below it for supporting the fibrous web being passed towards a web-gathering and sliver-forming conveyor belt arrangement 3. As shown in FIG. 2, the sliver-forming arrangement comprises a first belt 3*a* and a second belt 3*b* circulating in a direction to draw the carded web (not shown) from the plate 2 into the gap between adjacent pulleys 4*a* and 4*b* supporting the conveyor belts 3*a* and 3*b*. As the web is gathered into the gap between the belts 3*a* and 3*b* on the pulleys 4*a* and 4*b* it becomes formed as a sliver which then passes towards a condensing trumpet 5 positioned adjacent a nip roller sliver sensor 6, in this case using the "tongued and grooved" roller principle.

It will of course be appreciated that the use of the conveyor belts 3*a* and 3*b* is optional as the sliver forming mechanism and that some other means may instead be used to form the sliver. Equally other forms of web delivery apparatus may be used in place of the doffing roller 1 and plate 2.

As shown in FIG. 2, the sliver sensor comprises a driven "grooved" roller 7 within whose groove fits a driven shallow roller 8 whose periphery defines the "tongue" of the sensor such that the cylindrical peripheral surface of the roller 8 is parallel to the cylindrical floor in the groove of the roller 7. The "tongued" roller 8 is yieldably biased (by means to be described later herein) towards the "grooved" roller 7 so that the spacing between the groove floor and the cooperating peripheral surface of roller 8 at their point of "tangency" (together with the side walls of the groove in the roller 7) defines a channel for the contained sliver. Thus the spacing between the axes of the rollers 7 and 8 varies in response to increase or decrease in the volume of the sliver and provides a signal which can be sensed, by a suitable displacement sensor, to provide the "sliver weight" signal.

From the sensor 6 the sliver passes to a further condensing trumpet 9 at the inlet of the two-over-three draft box 10 having three driven bottom rollers 11 and two top rollers 12 driven by frictional engagement with the bottom rollers 11 through the agency of the intervening sliver being drafted. The bottom rollers 11 are driven such that the right hand bottom roller rotates with a higher peripheral speed than the left hand bottom roller.

Traditionally, with an autolevelling drafting function, the "tongued and grooved" rollers of the sliver sensor have their axes parallel to the axes of rotation of the drafting rollers. Equally, this is normally parallel to the direction of the axes of rotation of the carding cylinder (not shown) and of the various other cylinders and rollers of the carding apparatus, e.g. the licker-in and the doffer.

The carding apparatus employing the new geometry shown in the drawings has been found to give particularly good uniformity of sliver leaving the draft box, when assessed in terms of: the fibre alignment, the elimination of hooked ends in the fibres, and the uniformity of quality of the sliver.

As shown in FIG. 2, the "tongued" roller 8 is biased by means of a spring 13 towards the floor of the groove in the "grooved" roller 7 and a displacement sensor 14 measures the position of the axis of rotation of the tongued roller 8 for the purposes of detecting sliver thickness. In turn this provides a sliver thickness signal to a controller 15 which provides electronic control of the speeds of rotation of (i) the final drafting nip at the right hand rollers 11 and 12 and of (ii) the sliver coiler 19. Where more than two drafting nips are employed with drafting between each successive pair of nips, the controller 15 may simultaneously control the speed of rotation of the second and subsequent drafting nips. Hence, in each of these cases the variation of draft between the first and second drafting nips provides short term control of the sliver weight.

The controller 15 incorporates a programmable logic control unit (PLC) which incorporates a plurality of control programs and selects an appropriate one, in response to the throughput speed of the draft box 10, for a purpose to be described below.

Additionally, as illustrated schematically by the drive train 16 in FIG. 2, the sliver thickness signal from the displacement sensor 14 may be used to control the angular velocity of the feed roller to the licker-in in order to provide long term control of the sliver thickness.

The drive to the "tongued" roller 8, the "grooved" roller 7 and the first bottom drafting roller 11, all having substantially the same peripheral speed, is by way of a drive motor 17 having a drive output serving the "tongued and grooved" rollers and the first bottom drafting roller 11.

The variation of angular velocity of the final drafting rollers 11 and 12 to control sliver thickness may, for example, be derived by an epicyclic gearbox 18 having two drive inputs 18*a* and 18*b* and one drive output 18*c*, where one of the drive inputs (the main drive input 18*a*) is linked to the drive motor 17 of the ,first drafting nip and to the "tongued and grooved" roller web thickness sensor, and the other (controlling) input 18*b* is derived from a motor such as a DC motor or a stepping motor, serving as a servo motor driven by the controller 15 to vary the angular velocity of the controlled drive output 18*c* to the final drafting rollers and, by way of drive transmission 18*d*, to the coiler 19. For example this controlling drive input 18*b* may comprise drive to a torque arm sleeve of the epicyclic unit 18 and the main drive input 18*a* may comprise rotation of a casing of the same unit whereby changing the rate of rotation of the torque arm sleeve provides varying both output of a through shaft 18*c* of the epicyclic gearbox for the purposes of varying both the rate of rotation at the final drafting nip (via 18*d*) and the rate of operation of the coiler 19 which is mechanically linked to the drive to the final drafting nip to give a constant relationship between the speeds of the final drafting nip and the coiler.

The drive to the sliver forming belts 3*a* and 3*b* is itself variable in speed along with the main drive to the carding apparatus, in order to vary the throughput rate of the autoleveller and associated carding apparatus. A signal indicative of the variable speed selected for the carding apparatus is applied to the control unit 15 by way of line 20.

Although it is difficult to be absolutely certain as to the reasons why the drafting unit in accordance with the present invention provides such improved quality of drafted sliver, it is felt that the isolation of the "tongued and grooved" rollers from the drafting system is a significant improvement in that the "tongued and grooved" rollers are now able to convey the sliver freely, without slip, and without excessive compression, through the sliver sensing point while all of the drafting is carried out between the subsequent first and later drafting nips. Hence the force required to bias the "tongued and grooved" rollers together is lower than that which would normally be employed, and the absence of slip at the "tongued and grooved" roller combination ensures that the passage of the sliver through the sliver sensing point is as smooth as possible.

Although, in the above description, the draft box subjects the sliver to a draft of 1.5:1, it is conceivable for the draft box to be independent of a carding apparatus in which case a higher draft ratio will in all probability be used. It will of course be understood that in such an application the autoleveller may be used in conjunction with a doubling and drafting system.

Furthermore, although in the present instance the drafting roller configuration is that of a two-over-three draft box, there may be various other configurations possible. The drafting system may even employ apron drafting members at one or more of the drafting nips, and the drafting aprons may comprise a pair of such aprons in cooperation with one another or one apron in conjunction with a roller.

It is considered unusual for a coiler to be mechanically linked to the final drafting rollers of a short term drafting autoleveller because it has in the past been considered impractical in view of the high rotational inertia of the coiler and gearing. However, we have found that it is feasible to rely on the direct mechanical linkage of the coiler and the final drafting rollers, given a sufficiently powerful motor, and given sufficiently positive control of that motor to ensure that the final drafting rollers are driven with the precision required for short term autolevelling. The motor used may, for example be a brushless DC motor. A stepping motor is advantageous for the required accuracy of control.

The throughput speed of the autoleveller can be varied along with the throughput rate of the carding apparatus with which the autoleveller is operated. However, we propose that the program controlling the variable speed of the final drafting nip and the coiler in order to maintain a given sliver thickness is itself subject to variation when the throughput speed is changed.

We propose to employ the programmable logic control unit (PLC) for defining the response characteristics of the control function on the drives of the coiler and final drafting nip such that a time delay effective in the control unit is itself varied depending upon the throughput speed of the autoleveller (and associated carding apparatus). As the throughput speed increases, the time delay is expected to reduce, and vice versa. However, we have found that there is also the need for a constant correcting factor to the delay such that the delay $$T_d = K/S - k$$

where K and k are constants, and S is the throughput speed of the autoleveller.

Empirically determining the values for k and K in order to provide the best response rate to the control unit enables the PLC to be programmed in such a way that the response characteristics of the speed controller of the coiler and the final nip drives will give optimum uniformity of sliver thickness regardless of speed, over the entire range of available throughput speeds for the carding apparatus and autoleveller.

The fact that the coiler and the final drafting rollers are linked for operation with a constant relationship between their operating speeds, in order to avoid the need for a sliver store between the final drafting nip and the coiler to accommodate the increased delivery rate of sliver during those transient periods when the drafting ratio is increased in order to restore sliver thickness, results in a particularly high inertia factor in the control system. Surprisingly the stepping motor of adequate power is able to cope with this high inertia in the controlled equipment, but it has been found that the considerable influence this inertia has on the control characteristic causes difficulties when the throughput speed of the autoleveller, and/or the carding apparatus with which it is operated, is varied. We find it particularly surprising that the difficulties arising through the high inertia of the controlled final drafting nip, coiler and their drive means can be eliminated by building into the control equipment (incorporating the PLC) a time delay which is inversely proportional to the throughput speed but includes a linear correction constant as set out in the above formula.

When incorporating such a possibility for varying the throughput speed of the autoleveller it is particularly advantageous to separate the sliver thickness sensing means (either tongued and grooved rollers, or one of the alternative sensors, known per se, such as an air resistance sensor on the condenser trumpet or a photoelectric cell on the carding cylinder), so as to be positioned as far as possible ahead of the draft box so that at the highest throughput rates of sliver through the autoleveller there is still ample time remaining between the instant of passage of a particular part of the sliver through the sensor and its subsequent arrival at the variable speed drafting rollers for subjecting it to the appropriate draft to achieve the desired sliver thickness value.

We claim:

1. Carding apparatus including means converting a carded web into a sliver, and drafting apparatus drafting the converted sliver, said drafting apparatus comprising:

(a) driven drafting means comprising drafting rollers defining a series of drafting nips;

(b) an autoleveller for controlling the draft ratio of said driven drafting means, said autoleveller including:

(ba) a sliver sensing system for encountering the sliver before the drafting nips;

(bb) means for adjusting the sliver speed at at least one of said drafting nips, for controlling the draft ratio of said drafting nips in response to a signal from said sliver sensing system;

(bc) adjusting means for adjusting the operating speed of said drafting apparatus;

(bd) time delay means for ensuring that an appropriate correction drafting adjustment is effected by said draft ratio controlling means when the sensed part of the sliver is passing said at least one drafting nip; and (be) means responsive to said adjusting means for varying the time delay effected by said time delay means; wherein:

(bf) said time delay varying means are responsive to said adjusting means and effective to define a variable time delay as the arithmetic difference of a first component inversely proportional to the operating speed selected and a second component which is a constant.

2. Carding apparatus according to claim 1, wherein said time delay varying means comprise a programmable logic controller effective to vary said first component of the time delay and to maintain said second component constant.

3. Carding apparatus according to claim 2, wherein said programmable logic controller computes the time delay by subtracting said second component from said first component.

4. Carding apparatus according to claim 1, including driven coiler means arranged to receive the sliver delivered from said drafting means without any intervening storage, and means mechanically linking the drive of said coiler to the drive of the last of said drafting nips encountered by the sliver during by said drafting drafting means and effective to ensure that variation of the operating speed of said coiler means and the sliver speed at said last drafting nip is maintained in a constant relationship.

5. Carding apparatus according to claim 1, wherein said sliver sensing system comprises interengaging rollers of which one is a grooved roller having a groove with a floor, and the other is a tongued roller having a tongue engaging in said groove.

6. Carding apparatus according to claim 5, including means for driving said tongued and grooved rollers and a first one of first and second said drafting rollers defining the first drafting nip of the drafting means with related speeds such that the peripheral speed for said floor of said groove of the grooved roller remains substantially equal to that of the surface of said one drafting roller of the first drafting nip, and means biasing the tongued roller towards said floor of said groove of the grooved roller.

7. Carding apparatus according to claim 6, wherein said second drafting roller at said first drafting nip is biased against said first roller and derives frictional drive thereby.

8. Carding apparatus according to claim 6, and including displacement sensor means to detect change in the positioning of the axis of rotation of said tongued roller relative to that of said grooved roller, and control means responsive to said displacement sensor means for controlling the peripheral speed of said drafting rollers of the second of said drafting nips to be encountered by the sliver and any further said drafting nip encountered by the sliver subsequent to said first drafting nip to provide short term autolevelling of the sliver in the drafting means.

9. Carding apparatus according to claim 1, wherein said drafting means comprises a two-over-three drafting roller set.

10. Carding apparatus according to claim 1, including long term autolevelling means for controlling the rate of feed of staple fiber material fed to said carding apparatus independent of the operating speed selected by said adjusting means.

11. Carding apparatus according to claim 10 including a feed roller and a licker-in, said long term autolevelling means controlling the rate of rotation of said feed roller to said licker-in in response to a volume of sliver measured by said sliver sensing system.

* * * * *